US009162337B2

(12) United States Patent
Ishibashi

(10) Patent No.: US 9,162,337 B2
(45) Date of Patent: Oct. 20, 2015

(54) POLISHING APPARATUS

(71) Applicant: EBARA CORPORATION, Tokyo (JP)

(72) Inventor: Tomoatsu Ishibashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 14/139,764

(22) Filed: Dec. 23, 2013

(65) Prior Publication Data

US 2014/0187122 A1 Jul. 3, 2014

(30) Foreign Application Priority Data

Dec. 28, 2012 (JP) ..... 2012-287119

(51) Int. Cl.
*B24B 1/00* (2006.01)
*B24B 1/04* (2006.01)
*B24B 51/00* (2006.01)

(52) U.S. Cl.
CPC .. *B24B 1/04* (2013.01); *B24B 51/00* (2013.01)

(58) Field of Classification Search
CPC .... B24B 49/04; B24B 49/165; B24B 37/013; B24B 37/015; B24B 1/04; B24B 51/00
USPC ..... 451/1, 5, 7, 41, 53, 57, 67, 444
See application file for complete search history.

(56) References Cited

U.S. PATENT DOCUMENTS 5,607,718 A * 3/1997 Sasaki et al. ..... 438/584
5,746,646 A * 5/1998 Shibano ..... 451/36
5,888,124 A * 3/1999 Lin et al. ..... 451/67
5,908,347 A * 6/1999 Nakajima et al. ..... 451/5
6,227,944 B1 * 5/2001 Xin et al. ..... 451/41
6,358,119 B1 * 3/2002 Shih et al. ..... 451/36
6,409,576 B1 * 6/2002 Oguri et al. ..... 451/6
RE38,215 E * 8/2003 Shibata et al. ..... 451/41
6,780,088 B1 * 8/2004 Nishihara ..... 451/36
6,811,805 B2 * 11/2004 Gilliard et al. ..... 427/2.1
7,070,486 B2 * 7/2006 Doi et al. ..... 451/60
2002/0022445 A1 * 2/2002 Sotozaki et al. ..... 451/444
2005/0003737 A1 * 1/2005 Montierth et al. ..... 451/5
2007/0232203 A1 * 10/2007 Fukuda et al. ..... 451/56
2008/0202568 A1 * 8/2008 Benner ..... 134/198
2008/0274670 A1 * 11/2008 Tada et al. ..... 451/6
2008/0308120 A1 * 12/2008 Watanabe et al. ..... 134/1
2010/0048375 A1 * 2/2010 Horie et al. ..... 501/11
2010/0163083 A1 * 7/2010 Suzuki et al. ..... 134/184
2012/0048383 A1 * 3/2012 Tokoshima et al. ..... 137/1
2012/0325927 A1 * 12/2012 Tokoshima et al. ..... 239/8
2013/0220368 A1 * 8/2013 Ishibashi ..... 134/6

* cited by examiner

*Primary Examiner* — George Nguyen
(74) *Attorney, Agent, or Firm* — Baker & Hostetler LLP

(57) ABSTRACT

A polishing apparatus includes: a pure water supply line configured to supply deaerated pure water into the polishing apparatus; a gas dissolving unit coupled to the pure water supply line and configured to dissolve a gas in the deaerated pure water to produce gas-dissolved pure water; a gas-dissolved pure water delivery line coupled to the gas dissolving unit and configured to deliver the gas-dissolved pure water; an ultrasonic cleaning unit coupled to the gas-dissolved pure water delivery line and configured to impart an ultrasonic vibration energy to the gas-dissolved pure water, which has been delivered through the gas-dissolved pure water delivery line, and then eject the gas-dissolved pure water onto an object to be cleaned; and a controller configured to control the gas dissolving unit and the ultrasonic cleaning unit.

8 Claims, 7 Drawing Sheets

POLISHING APPARATUS

CROSS REFERENCE TO RELATED APPLICATION

This application claims priority to Japanese Patent Application No. 2012-287119 filed Dec. 28, 2012, the entire contents of which are hereby incorporated by reference.

BACKGROUND OF THE INVENTION

1. Field of the Invention

The present invention relates to a polishing apparatus, and more particularly to a polishing apparatus for polishing and planarizing a surface of a substrate, such as a wafer, while preventing defects that could be caused by particles contained in a polishing liquid or other substances attached to processing mechanisms disposed in the polishing apparatus.

2. Description of the Related Art

A polishing apparatus for polishing a surface of a wafer typically has therein various types of processing mechanisms including a polishing table having a polishing surface formed by a polishing pad and a polishing head (top ring) for holding the wafer. The wafer is held by the polishing head and pressed at a predetermined pressure against the polishing surface of the polishing pad, while the polishing table and the polishing head are moved relative to each other. As a result, the wafer is placed in sliding contact with the polishing surface, so that the surface of the wafer is polished to a flat mirror finish. In chemical mechanical polishing (CMP), a polishing liquid (i.e., slurry) containing fine particles therein is supplied onto the polishing surface during polishing of the wafer. After polishing, the wafer is transported by a transporter to a cleaning unit and a drying unit, where the polished wafer is cleaned and then dried. Thereafter, the wafer is removed from the polishing apparatus.

When the substrate, such as wafer, is polished while the polishing liquid is supplied, a large amount of polishing liquid and particles (e.g., polishing debris) remain on the polishing surface of the polishing table. Moreover, during polishing, the polishing liquid is scattered around the polishing table and may be attached to the processing mechanisms arranged around the polishing table. Further, the polishing liquid may be attached to a transporting unit for transporting the polished substrate and a polishing tool of the cleaning unit for cleaning the surface of the polished substrate. If the polishing liquid and the polishing debris remain on the polishing surface of the polishing table and/or if the polishing liquid is attached to the processing mechanisms around the polishing table and the cleaning tool of the cleaning unit, defects of the polished substrate may occur.

Typically, various types of cleaning units are provided at predetermined locations in the polishing apparatus. These cleaning units have jet orifices that eject a cleaning liquid periodically toward predetermined portions of the polishing apparatus so as to wash away the polishing liquid attached to the polishing table and the mechanisms around the table. Such a cleaning liquid may typically be deaerated pure water supplied from a factory into the polishing apparatus.

An ultrasonic cleaning unit is known as the cleaning unit provided in the apparatus. This ultrasonic cleaning unit uses high-pressure water with cavitation for cleaning the polishing apparatus. The deaerated pure water (i.e., cleaning liquid) supplied from the factory into the polishing apparatus is typically used as the high-pressure water of the ultrasonic cleaning unit.

The deaerated pure water (i.e., cleaning liquid) supplied from the factory into the polishing apparatus contains very little gas therein. For example, a concentration of dissolved oxygen in the deaerated pure water (i.e., DO value) is typically at most 20 ppb, and may be even controlled to at most 5 ppb. Fabrication of state-of-the-art devices may require use of the pure water having a dissolved-oxygen concentration of 1 ppb.

The ultrasonic cleaning process utilizing the cavitation is a physical cleaning process that uses a gas-containing liquid that has been processed by ultrasonic wave. An example of a specific condition of the dissolved gas required for the liquid that is to be supplied to the ultrasonic cleaning unit is that "the concentration of the dissolved gas in the liquid is in a range of 1 ppm to 15 ppm". It is also known that, if an excessive amount of gas is dissolved in the liquid for use in the ultrasonic cleaning process, sufficient cleaning properties cannot be obtained.

As described above, when the deaerated pure water with the DO value of at most 20 ppb is used in the ultrasonic cleaning process, it is difficult to obtain sufficient cleaning properties because the pure water contains very little dissolved gas. Accordingly, in the cleaning process for the apparatus that is conducted under particle contamination due to the polishing liquid, the use of the deaerated pure water may prevent the ultrasonic cleaning process from achieving full advantages of its cleaning effect.

SUMMARY OF THE INVENTION

The present invention has been made in view of the foregoing issues. It is therefore an object of the present invention to provide a polishing apparatus capable of performing an ultrasonic cleaning process on the interior of the apparatus under an optimal condition that can fully achieve a proper cleaning effect of the ultrasonic cleaning process.

A polishing apparatus, includes: a pure water supply line configured to supply deaerated pure water into the polishing apparatus; a gas dissolving unit coupled to the pure water supply line and configured to dissolve a gas in the deaerated pure water to produce gas-dissolved pure water; a gas-dissolved pure water delivery line coupled to the gas dissolving unit and configured to deliver the gas-dissolved pure water; an ultrasonic cleaning unit coupled to the gas-dissolved pure water delivery line and configured to impart an ultrasonic vibration energy to the gas-dissolved pure water, which has been delivered through the gas-dissolved pure water delivery line, and then eject the gas-dissolved pure water onto an object to be cleaned; and a controller configured to control the gas dissolving unit and the ultrasonic cleaning unit.

The gas dissolving unit produces the gas-dissolved pure water containing a sufficient amount of the gas dissolved therein, and the ultrasonic cleaning unit imparts the ultrasonic vibration energy to the gas-dissolved pure water and eject the gas-dissolved pure water to the object to be cleaned. Therefore, the polishing apparatus can perform the ultrasonic cleaning process under the optimal condition that can fully achieve the proper cleaning effect of the ultrasonic cleaning process.

The polishing apparatus further includes a sensor configured to measure a concentration of the dissolved gas in the gas-dissolved pure water delivered through the gas-dissolved pure water delivery line to the ultrasonic cleaning unit and configured to transmit a measured value of the concentration of the dissolved gas to the controller.

The controller is configured to control the gas dissolving unit based on the measured value of the concentration of the dissolved gas so as to maintain the concentration of the dissolved gas within a predetermined range.

The polishing apparatus further includes a temperature regulating unit configured to regulate a temperature of the gas-dissolved pure water delivered through the gas-dissolved pure water delivery line to the ultrasonic cleaning unit.

The controller is configured to control the temperature regulating unit based on a measured value of the temperature of the gas-dissolved pure water so as to maintain the temperature of the gas-dissolved pure water within a predetermined range.

The temperature of the deaerated pure water supplied into the polishing apparatus is typically in a range of 21° C. to 25° C. The temperature regulating unit regulates the temperature of the gas-dissolved pure water in a range of 18° C. to 40° C. to thereby enables the ultrasonic cleaning unit to achieve a high cleaning effect.

According to the present invention, the gas dissolving unit produces the gas-dissolved pure water containing a sufficient amount of the gas dissolved therein, and the ultrasonic cleaning unit imparts the ultrasonic vibration energy to the gas-dissolved pure water and ejects the gas-dissolved pure water to the object to be cleaned. Therefore, the polishing apparatus can perform the ultrasonic cleaning process on mechanisms to remove particles of the polishing liquid or polishing debris in the apparatus under the optimal condition that can fully achieve a proper cleaning effect of the ultrasonic cleaning process.

DETAILED DESCRIPTION

Embodiments will be described below with reference to the drawings.

Figure 1:
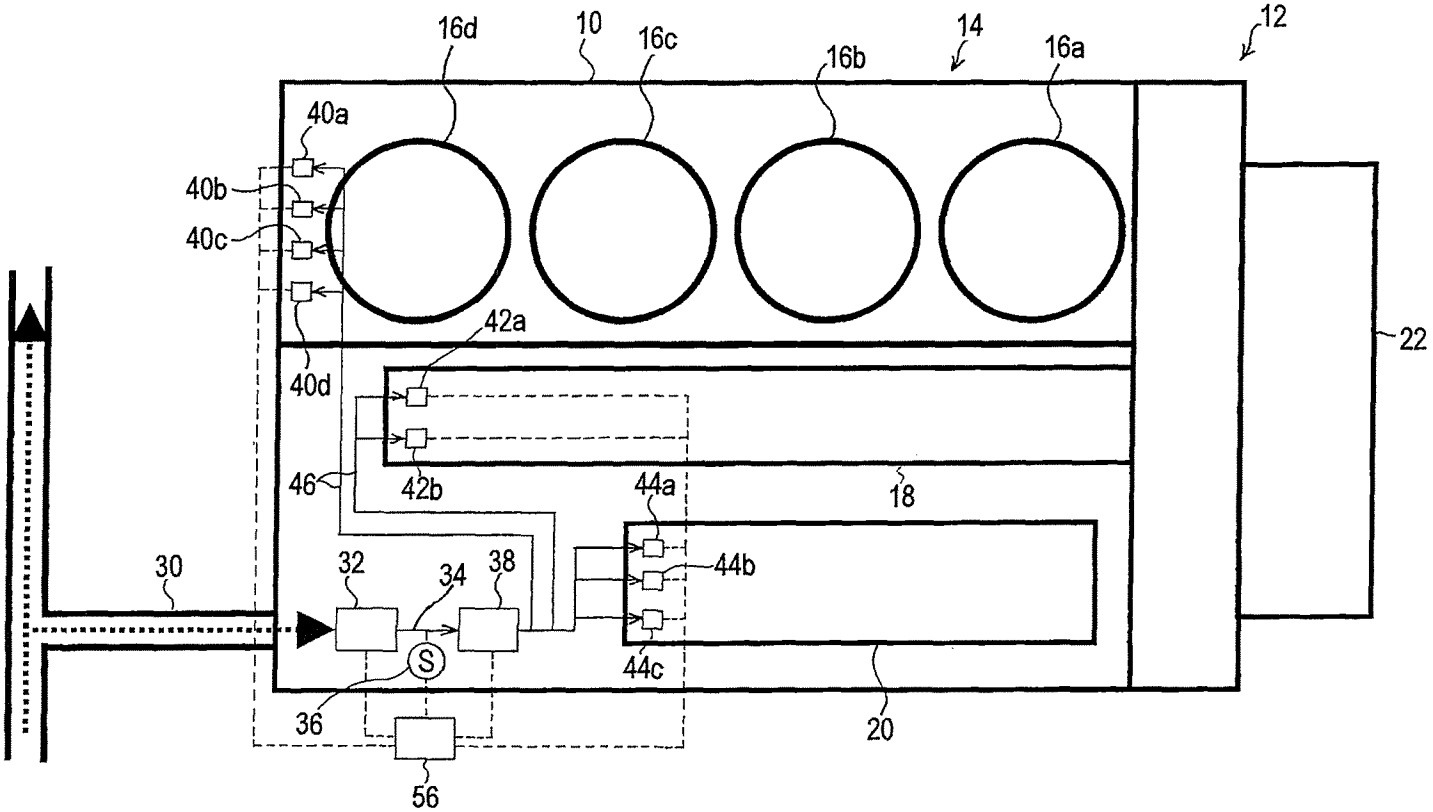
FIG. 1 is a plan view schematically showing an embodiment of an overall polishing apparatus.

FIG. 1 is a schematic plan view showing an embodiment of an entire polishing apparatus. As shown in FIG. 1, the polishing apparatus has a housing 10 in an approximately rectangular shape. An interior of the housing 10 is divided into a loading and unloading section 12 and a processing section 14. In the processing section 14, there are provided a plurality of (four in this embodiment) polishing units 16*a*, 16*b*, 16*c*, and 16*d*, a transporting unit 18, and a cleaning and drying unit 20, all of which serve as processing mechanisms. The polishing units 16*a*, 16*b*, 16*c*, and 16*d* are arranged along the longitudinal direction of the polishing apparatus.

The loading and unloading section 12 includes a front loader 22 for receiving thereon a substrate cassette storing a plurality of substrates, such as wafers. The front loader 22 is disposed adjacent to the housing 10 and is capable of receiving thereon an open cassette, a SMIF (standard manufacturing interface) pod or a FOUP (front opening unified pod). Each of the SMIF and the FOUP is a hermetically sealed container which houses therein a substrate cassette and is covered with a partition wall, and thus can keep independent internal environment isolated from an external space.

A transfer robot (not shown) arranged in the loading and unloading section 12 is configured to remove one substrate from the substrate cassette placed on the front loader 22, and transfers the substrate to the transporting unit 18. The transporting unit 18 transports the substrate to one of the polishing units 16*a*, 16*b*, 16*c*, and 16*d*, receives the substrate that has been polished by one of the polishing units 16*a*, 16*b*, 16*c*, and 16*d*, and transports the polished substrate to the cleaning and drying unit 20. The substrate, which has been cleaned and dried by the cleaning and drying unit 20, is returned to the substrate cassette placed on the front loader 22 by the transfer robot arranged in the loading and unloading section 12.

A pure water supply line 30 extends into the housing 10 for supplying deaerated pure water delivered from a factory into the polishing apparatus. This pure water has been deaerated to, e.g., at most 20 ppb which represents a DO value. A gas dissolving unit 32 is coupled to the pure water supply line 30. This gas dissolving unit 32 is configured to dissolve a gas in the pure water using a permeable membrane or bubbling to increase a concentration of the dissolved gas to thereby produce gas-dissolved pure water having the increased concentration of the dissolved gas. The concentration of the dissolved gas in this gas-dissolved pure water may be in a range of 1 to 15 ppm or may be in a range of 3 to 8 ppm. The gas dissolving unit 32 produces the gas-dissolved pure water containing a sufficient amount of gas dissolved therein, and ultrasonic cleaning units 40*a*, 40*b*, 40*c*, 40*d*, 42*a*, 42*b*, 44*a*, 44*b*, and 44*c*, which will be discussed later, impart ultrasonic vibration energy to the gas-dissolved pure water. As a result, ultrasonic cleaning can be performed under an optimal condition that can achieve full advantages of its proper cleaning effect.

The gas to be dissolved in the pure water may be an inert gas, such as $N_2$ gas or argon gas. A gas (e.g., oxygen) in the air existing under a clean room environment may also be used if it does not affect the cleaning of the polishing apparatus. A gas, such as carbon dioxide or hydrogen gas, may be dissolved in the pure water to produce functional water, such as carbon dioxide water or hydrogen water. This functional water may be used as the gas-dissolved pure water.

A gas-dissolved pure water delivery line 34 is coupled to the gas dissolving unit 32 for delivering the gas-dissolved pure water produced in the gas dissolving unit 32. This gas-dissolved pure water delivery line 34 is provided with a sensor 36 for measuring the concentration of the dissolved gas in the gas-dissolved pure water flowing through the gas-dissolved pure water delivery line 34 and a temperature regulating unit 38 for regulating a temperature of the gas-dissolved pure water flowing through the gas-dissolved pure water delivery line 34.

Figure 2:
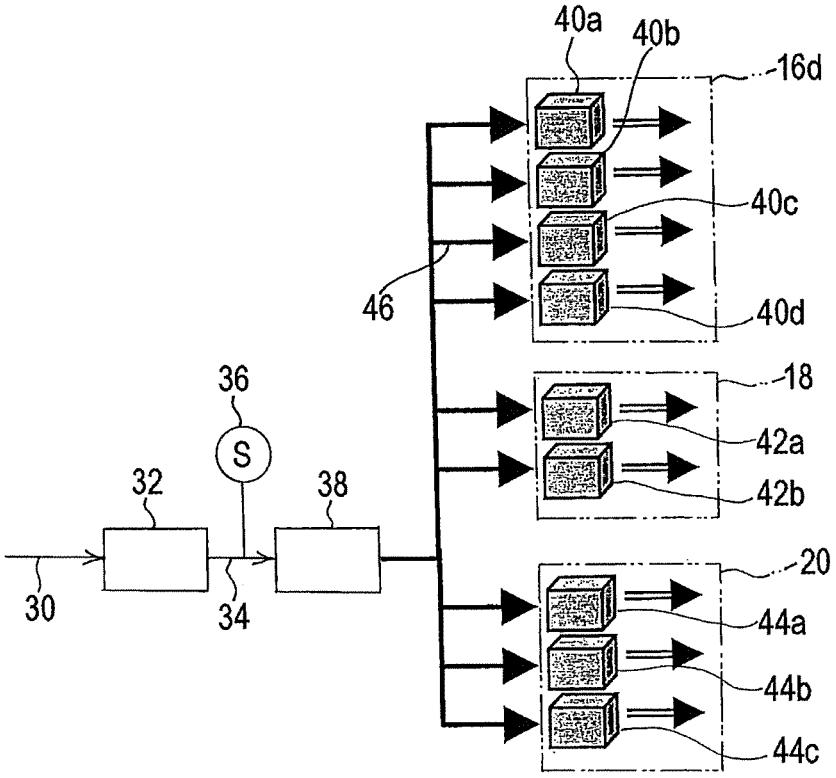
FIG. 2 is a view showing arrangement of a pure water supply line, a gas dissolving unit, a gas-dissolved pure water delivery line, a sensor, a temperature regulating unit, and ultrasonic cleaning units.

In this embodiment, as shown in FIG. 2, four ultrasonic cleaning units 40*a*, 40*b*, 40*c*, 40*d* are provided in the polishing unit 16*d*, two ultrasonic cleaning units 42*a*, 42*b* are provided in the transporting unit 18, and three ultrasonic cleaning units 44*a*, 44*b*, and 44*c* are provided in the cleaning and drying unit 20. Although not shown in the drawing, four ultrasonic cleaning units are provided in each of the other polishing units 16*a*, 16*b*, and 16*c* as well. The gas-dissolved pure water delivery line 34 is divided into multiple branch lines 46 at a branch point located downstream of the temperature regulating unit 38. The ultrasonic cleaning units 40*a*, 40*b*, 40*c*, 40*d*, 42*a*, 42*b*, 44*a*, 44*b*, and 44*c* are coupled to distal ends of the branch lines 46, respectively.

Figure 3:
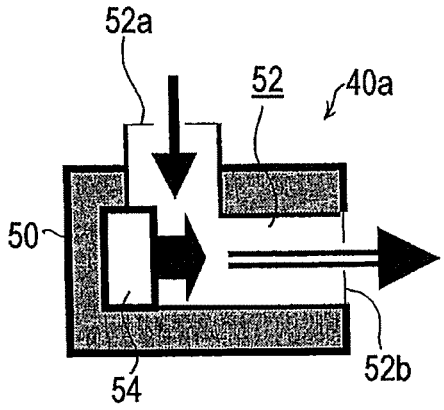
FIG. 3 is a cross-sectional view of the ultrasonic cleaning unit.

As shown in FIG. 3, the ultrasonic cleaning unit 40*a* has a piezoelectric element 54 serving as an ultrasonic transducer, which is disposed in a fluid passage 52 formed in a body structure 50. When the piezoelectric element 54 is energized while high-pressure gas-dissolved pure water is injected from an injection aperture 52*a* into the fluid passage 52, an ultrasonic vibration energy is imparted to the gas-dissolved pure water, which is then ejected through a jet orifice 52*b*.

The other ultrasonic cleaning units 40*b*, 40*c*, 40*d*, 42*a*, 42*b*, 44*a*, 44*b*, and 44*c* have the same structure as the ultrasonic cleaning unit 40*a*.

A controller 56 is further provided for controlling the gas dissolving unit 32, the temperature regulating unit 38, and the ultrasonic cleaning units 40*a*, 40*b*, 40*c*, 40*d*, 42*a*, 42*b*, 44*a*, 44*b*, and 44*c*. A signal from the sensor 36 is transmitted to the controller 56.

The sensor 36 is configured to measure the concentration of the dissolved gas in the gas-dissolved pure water flowing through the gas-dissolved pure water delivery line 34 to the ultrasonic cleaning units 40*a*, 40*b*, 40*c*, 40*d*, 42*a*, 42*b*, 44*a*, 44*b*, and 44*c*. The controller 56 controls the gas dissolving unit 32 based on a measured value of the concentration of the dissolved gas such that the concentration of the dissolved gas in the gas-dissolved pure water, which is ejected from the ultrasonic cleaning units 40*a*, 40*b*, 40*c*, 40*d*, 42*a*, 42*b*, 44*a*, 44*b*, and 44*c*, is within a predetermined range.

Figure 4:
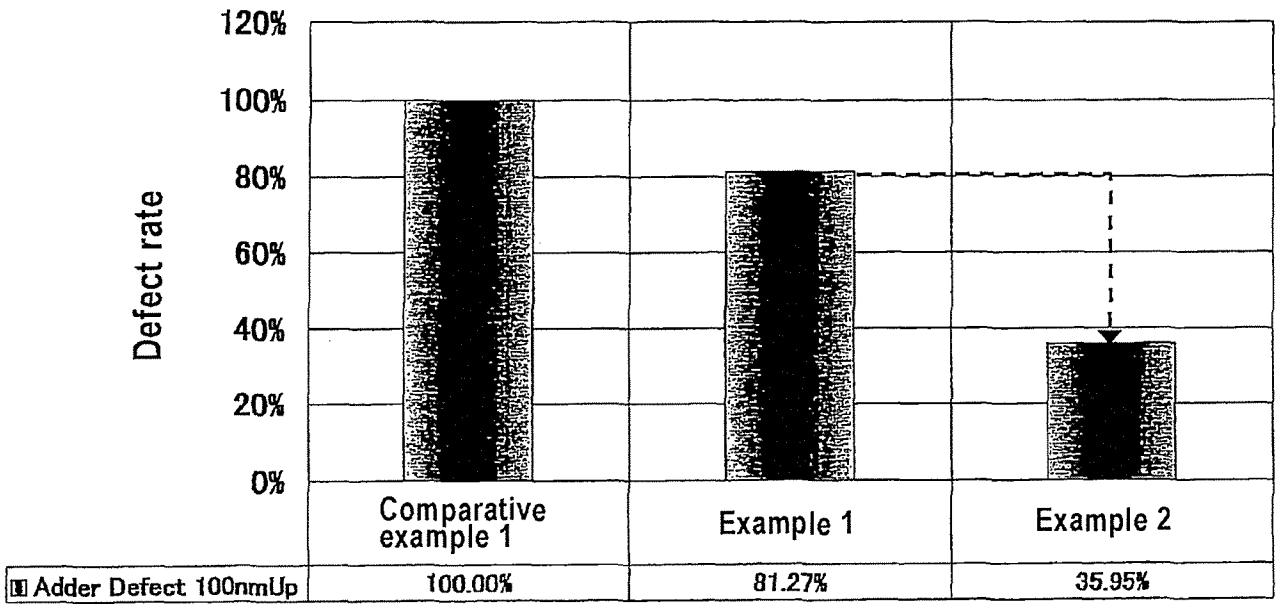
FIG. 4 is a graph showing measurement results of the number of defects having a size of not less than 100 nm remaining after the ultrasonic cleaning process in an example 1, an example 2, and a comparative example 1, the measurement results being shown by percentage (defect rate) using the defect rate in the comparative example 1 as 100%.

FIG. 4 is a graph showing measurement results of the number of defects having a size of not less than 100 nm remaining after the ultrasonic cleaning process as an example 1. This example 1 shows the measurement result of the number of defects when the ultrasonic cleaning process was conducted using the gas-dissolved pure water whose concentration of the dissolved gas was not more than 1.0 ppm. FIG. 4 further shows measurement results of the number of defects having a size of not less than 100 nm remaining after the ultrasonic cleaning process as an example 2. This example 2 shows the measurement result of the number of defects when the ultrasonic cleaning process was conducted using the gas-dissolved pure water whose concentration of the dissolved gas was not less than 1.5 ppm. FIG. 4 further shows measurement results of the number of defects having a size of not less than 100 nm remaining after the ultrasonic cleaning process as a comparative example 1. This comparative example 1 shows the measurement result of the number of defects when the ultrasonic cleaning process was conducted using the deaerated pure water having a concentration of not more than 1.0 ppb which is the DO value (i.e., the DO value≤1.0 ppb). In FIG. 4, the measurement results are shown by percentage (defect rate) using the defect rate in the comparative example 1 as 100%.

As can be seen from FIG. 4, it is possible to reduce the number of defects having a size of not less than 100 nm by using the gas-dissolved pure water whose concentration of the dissolved gas is not more than 1.0 ppm or not less than 1.5 ppm, as compared with the case where the ultrasonic cleaning process is performed using the deaerated pure water having the concentration of not more than 1.0 ppb which is the DO value (i.e., the DO value≤1.0 ppb). In particular, the measurement results show that the number of defects having a size of not less than 100 nm on the substrate can remarkably be reduced by increasing the concentration of the dissolved gas to 1.5 ppm or more.

The temperature of the pure water supplied through the pure water supply line 30 is regulated typically in a range of 21° C. to 25° C. In the ultrasonic cleaning process, use of liquid having a certain high temperature may provide high ultrasonic cleaning properties. Therefore, in this embodiment, the temperature regulating unit 38 regulates the temperature of the gas-dissolved pure water flowing through the gas-dissolved pure water delivery line 34 to the ultrasonic cleaning units 40*a*, 40*b*, 40*c*, 40*d*, 42*a*, 42*b*, 44*a*, 44*b*, and 44*c*. More specifically, the temperature regulating unit 38 regulates the temperature of the gas-dissolved pure water in a range of 18° C. to 40° C.

In this embodiment, the controller 56 uses the concentration of the gas dissolved in the gas-dissolved pure water and the temperature of the gas-dissolved pure water as parameters for optimizing the ultrasonic cleaning properties, and is configured to be able to control the concentration and the temperature. More specifically, the controller 5 controls the gas dissolving unit 32 based on the measured value of the concentration of the dissolved gas such that the concentration of the gas dissolved in the gas-dissolved pure water is maintained in a predetermined range, and further controls the temperature regulating unit 38 based on the measured value of the temperature of the gas-dissolved pure water such that the temperature of the gas-dissolved pure water is maintained in a predetermined range. The temperature of the gas-dissolved pure water is measured by a thermometer incorporated in the temperature regulating unit 38. The thermometer may be provided separately from the temperature regulating unit 38.

Frequency (e.g., from several hundreds Hz to 5 MHz) and output power of the piezoelectric element 54 of each of the ultrasonic cleaning units 40*a*, 40*b*, 40*c*, 40*d*, 42*a*, 42*b*, 44*a*, 44*b*, and 44*c* are controlled by the controller 56.

Figure 5:
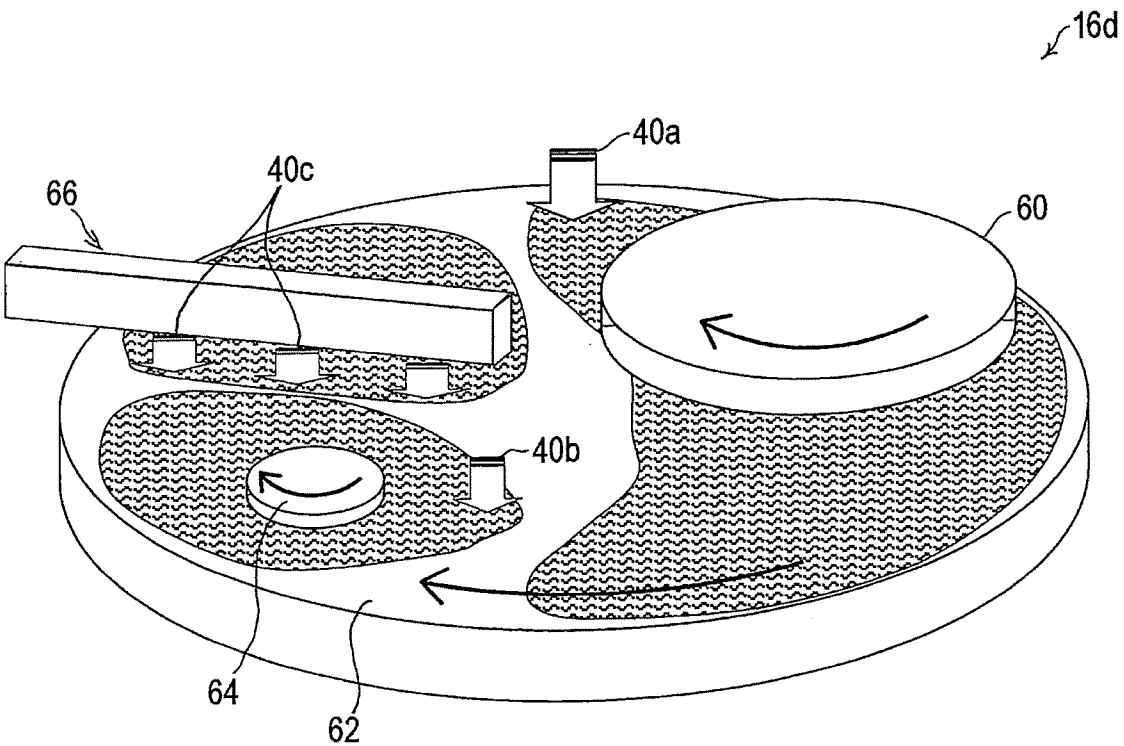
FIG. 5 is a view showing arrangement of a polishing unit and the ultrasonic cleaning units provided in the polishing unit and are used for the ultrasonic cleaning.

FIG. 5 is a view showing arrangement of the polishing unit 16*d* and the ultrasonic cleaning units 40*a*, 40*b*, 40*c*, 40*d* which are provided in the polishing unit 16*d* and are used for the ultrasonic cleaning. In this polishing unit 16*d*, a substrate (not shown) is held and rotated by a polishing head 60, and is pressed by the polishing head 60 against a rotating polishing pad 62. A polishing liquid (slurry) is supplied onto the polishing pad 52, so that the substrate is polished by the sliding contact with the polishing pad 62 in the presence of the slurry.

The ultrasonic cleaning unit 40*a* is used for cleaning the polishing pad 62 when the substrate (not shown), held on a lower surface of the polishing head 60 of the polishing unit 16*d*, is being water-polished. Specifically, the gas-dissolved pure water, to which the ultrasonic vibration energy has been imparted from the ultrasonic cleaning unit 40*a*, is ejected toward the polishing pad 62 during water-polishing of the substrate to thereby clean the polishing pad 62. In this water-polishing, instead of the polishing liquid, pure water is supplied onto the polishing pad 62. During water-polishing, the substrate is pressed against the polishing pad 62 at a load lower than when the substrate is polished using the slurry.

The ultrasonic cleaning unit 40*b* is used for cleaning the polishing pad 62 when the polishing pad 62 is being dressed (or conditioned) by a dresser 64. Specifically, the gas-dissolved pure water, to which the ultrasonic vibration energy has been imparted from the ultrasonic cleaning unit 40*b*, is ejected toward the polishing pad 62 during dressing of the polishing pad 62 to thereby clean the polishing pad 62.

The ultrasonic cleaning unit 40*c* is used for cleaning the polishing pad 62 using an atomizer 66. Specifically, the gas-dissolved pure water, to which the ultrasonic vibration energy has been imparted from the ultrasonic cleaning unit 40*c* attached to the atomizer 66, is ejected toward the polishing pad 62 to thereby clean the polishing pad 62.

Although not shown in FIG. 5, the ultrasonic cleaning unit 40*d* shown in FIG. 1 and FIG. 2 is arranged in a cleaning position for cleaning the dresser 64 and is used to clean the dresser 64. Specifically, the gas-dissolved pure water, to which the ultrasonic vibration energy has been imparted from the ultrasonic cleaning unit 40*d*, is ejected toward a sliding contact portion of the dresser 64 to thereby clean the dresser 64. Although not shown, the other polishing units 16*a*, 16*b*, and 16*c* have the same structures as the polishing unit 16*d*.

Figure 6:
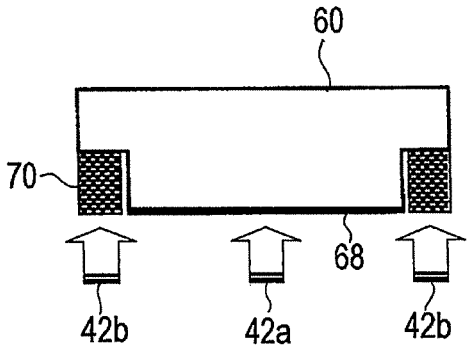
FIG. 6 is a view showing arrangement of a polishing head that has released a substrate to a transporting unit and the ultrasonic cleaning units which are provided in the transporting unit and are used for the ultrasonic cleaning.
Figure 7:
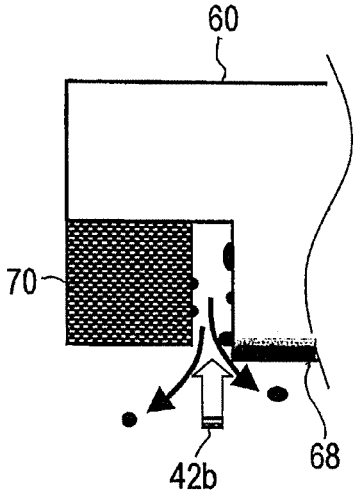
FIG. 7 is an enlarged view of a part of FIG. 6.

FIG. 6 and FIG. 7 are views each showing arrangement of the polishing head 60 that has released a substrate to the transporting unit 18 and the ultrasonic cleaning units 42*a*, 42*b* which are provided in the transporting unit 18 and are used for the ultrasonic cleaning. In this embodiment, the ultrasonic cleaning unit 42*a* is used for cleaning a membrane 68, which serves as a bottom of the polishing head 60 to hold the substrate thereon via vacuum suction. Specifically, after the polishing head 60 releases the substrate to the transporting unit 18, the gas-dissolved pure water, to which the ultrasonic vibration energy has been imparted from the ultrasonic cleaning unit 42*a*, is ejected toward the membrane 68 to thereby clean the membrane 68.

The ultrasonic cleaning unit 42*b* is used for cleaning a gap between the membrane 68 and a retaining ring 70 provided around the membrane 68. Specifically, after the polishing head 60 has released the substrate to the transporting unit 18, the gas-dissolved pure water, to which the ultrasonic vibration energy has been imparted from the ultrasonic cleaning unit 42*b*, is ejected toward the gap between the membrane 68 and the retaining ring 70 to thereby clean the gap between the membrane 68 and the retaining ring 70.

Figure 8:
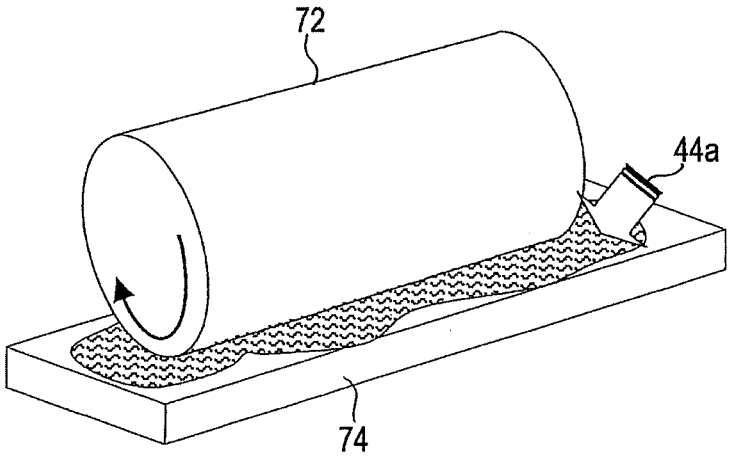
FIG. 8 is a view showing arrangement of a cleaning and drying unit and the ultrasonic cleaning unit which is provided in the cleaning and drying unit and is used for the ultrasonic cleaning.

FIG. 8 is a view showing arrangement of the cleaning and drying unit 20 and the ultrasonic cleaning unit 44*a* which is provided in the cleaning and drying unit 20 and is used for the ultrasonic cleaning. In this embodiment, the ultrasonic cleaning unit 44*a* is used for cleaning a roll cleaning member 72 of the cleaning and drying unit 20. Specifically, while the roll cleaning member 72 is placed in sliding contact with a cleaning plate 74, the gas-dissolved pure water, to which the ultrasonic vibration energy has been imparted from the ultrasonic cleaning unit 44*a*, is ejected toward a sliding contact area between the roll cleaning member 72 and the cleaning plate 74 to thereby clean the roll cleaning member 72.

Figure 9:
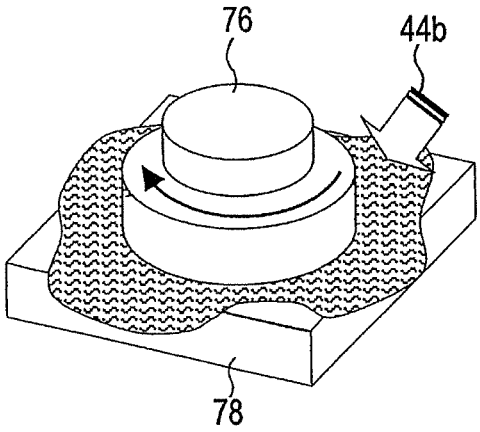
FIG. 9 is a view showing arrangement of the cleaning and drying unit and another ultrasonic cleaning unit which is provided in the cleaning and drying unit and is used for the ultrasonic cleaning.

FIG. 9 is a view showing arrangement of the cleaning and drying unit 20 and another ultrasonic cleaning unit 44*b* which is provided in the cleaning and drying unit 20 and is used for the ultrasonic cleaning. In this embodiment, the ultrasonic cleaning unit 44*b* is used for cleaning a pencil-type cleaning member 76 of the cleaning and drying unit 20. Specifically, while the pencil-type cleaning member 76 is placed in sliding contact with a cleaning plate 78, the gas-dissolved pure water, to which the ultrasonic vibration energy has been imparted from the ultrasonic cleaning unit 44*b*, is ejected toward a sliding contact area between the pencil-type cleaning member 76 and the cleaning plate 78 to thereby clean the pencil-type cleaning member 76.

Although not shown in FIG. 8 and FIG. 9, the ultrasonic cleaning unit 44*c* shown in FIG. 2 is arranged in a cleaning position for cleaning a roll rotating mechanism for rotating the roll cleaning member of the cleaning and drying unit 20 and is used for cleaning the roll rotating mechanism. Specifically, the gas-dissolved pure water, to which the ultrasonic vibration energy has been imparted from the ultrasonic cleaning unit 44*c*, is ejected toward the roll rotating mechanism to thereby clean the roll rotating mechanism.

As discussed above, the gas dissolving unit produces the gas-dissolved pure water containing a sufficient amount of the gas dissolved therein, and the ultrasonic cleaning unit imparts the ultrasonic vibration energy to the gas-dissolved pure water. Therefore, the polishing apparatus can perform the ultrasonic cleaning process on mechanisms to remove particles of the polishing liquid or polishing debris in the apparatus under the optimal condition that can fully achieve the proper cleaning effect of the ultrasonic cleaning process.

Although certain embodiments of the present invention have been shown and described in detail, it should be understood that various changes and modifications may be made without departing from the scope of the technical concept.

What is claimed is:

1. A polishing apparatus, comprising:

a pure water supply line configured to supply deaerated pure water into the polishing apparatus;

a gas dissolving unit coupled to the pure water supply line and configured to dissolve a gas in the deaerated pure water to produce gas-dissolved pure water;

a gas-dissolved pure water delivery line coupled to the gas dissolving unit and configured to deliver the gas-dissolved pure water;

an ultrasonic cleaning unit having a fluid passage coupled to the gas-dissolved pure water delivery line and configured to impart an ultrasonic vibration energy to the gas-dissolved pure water when flowing in the fluid passage, the fluid passage having a jet orifice oriented toward at least one of mechanisms of the polishing apparatus; and a controller configured to control the gas dissolving unit and the ultrasonic cleaning unit.

2. The polishing apparatus according to claim 1, wherein the at least one of the mechanisms comprises a polishing pad provided in a polishing unit for polishing a substrate.

3. The polishing apparatus according to claim 1, wherein the at least one of the mechanisms comprises a dresser configured to dress a polishing pad provided in a polishing unit for polishing a substrate.

4. The polishing apparatus according to claim 1, wherein the at least one of the mechanisms comprises a polishing head having a membrane for pressing a substrate against a polishing pad to polish the substrate, the jet orifice is oriented toward the membrane, and the ultrasonic cleaning unit is configured to eject the gas-dissolved pure water through the jet orifice toward the membrane after the polishing head has released the substrate that has been polished.

5. The polishing apparatus according to claim 1, wherein the at least one of the mechanisms comprises a polishing head having a membrane for pressing a substrate against a polishing pad to polish the substrate and a retaining ring surrounding the membrane, the jet orifice is oriented toward a gap between the membrane and the retaining ring, and the ultrasonic cleaning unit is configured to eject the gas-dissolved pure water through the jet orifice toward the gap after the polishing head has released the substrate that has been polished.

6. The polishing apparatus according to claim 1, wherein the at least one of the mechanisms comprises a roll cleaning member for cleaning a substrate that has been polished and a cleaning plate that is to clean the roll cleaning member, and the jet orifice is oriented toward a contact area between the roll cleaning member and the cleaning plate.

7. The polishing apparatus according to claim 1, wherein the at least one of the mechanisms comprises a pencil-type cleaning member for cleaning a substrate that has been polished and a cleaning plate that is to clean the pencil-type cleaning member, and the jet orifice is oriented toward a contact area between the pencil-type cleaning member and the cleaning plate.

8. The polishing apparatus according to claim 1, wherein the at least one of the mechanisms comprises a roll rotating mechanism configured to rotate a roll cleaning member for cleaning a substrate that has been polished.

* * * * *